US008528540B2

(12) United States Patent
Marple

(10) Patent No.: US 8,528,540 B2
(45) Date of Patent: Sep. 10, 2013

(54) FIRE GRATE FOR ENHANCED COMBUSTION WITH VERTICAL AND HORIZONTAL EXPANSION SLEEVES

(75) Inventor: Steve Marple, Bayfield, CO (US)

(73) Assignee: Earth's Flame, Inc., Corona, CA (US)

( * ) Notice: Subject to any disclaimer, the term of this patent is extended or adjusted under 35 U.S.C. 154(b) by 0 days.

(21) Appl. No.: 13/453,865

(22) Filed: Apr. 23, 2012

(65) Prior Publication Data

US 2012/0204858 A1 Aug. 16, 2012

Related U.S. Application Data

(63) Continuation of application No. 12/620,453, filed on Nov. 17, 2009, now abandoned, which is a continuation-in-part of application No. 12/501,869, filed on Jul. 13, 2009, now abandoned.

(51) Int. Cl.
*F24B 1/19* (2006.01)

(52) U.S. Cl.
USPC ..... 126/512; 126/518; 126/540; 126/541; 126/525; 110/298; 110/300; 110/311

(58) Field of Classification Search
USPC ..... 126/512, 518, 540, 541, 504, 521, 126/522, 525, 163 R; 110/298, 300, 311
See application file for complete search history.

(56) References Cited

U.S. PATENT DOCUMENTS

| | | | | |
|---|---|---|---|---|
| 92,526 | A | 7/1869 | Hamilton | |
| 114,280 | A | 5/1871 | Farris | |
| 1,191,848 | A | 7/1916 | Stout | |
| 1,365,912 | A * | 1/1921 | Greene | 126/518 |
| 3,054,155 | A | 9/1962 | Zickefoose | |
| 3,380,472 | A | 4/1968 | Leighton | |
| 3,416,733 | A | 12/1968 | Leighton | |
| 3,905,351 | A | 9/1975 | Hatfield et al. | |
| 3,942,509 | A | 3/1976 | Sasser | |

(Continued)

FOREIGN PATENT DOCUMENTS

GB 873025 7/1961

OTHER PUBLICATIONS

National Risk Management Research Laboratory, "Wood Stove Emissions: Particle Size and Chemical Composition", United States Environmental Protection Agency, EPA-600-R-00-050, Jun. 2000, 51 pages.

(Continued)

*Primary Examiner* — Avinash Savani
(74) *Attorney, Agent, or Firm* — Stetina Brunda Garred & Brucker

(57) ABSTRACT

An improved fire grate may provide fresh oxygen rich air to a secondary combustion zone, created by the improved fire grate, of a combustion chamber where a combustion gas stream is typically oxygen starved assisting in the burning process of incompletely burned particulates and reducing other harmful emissions. A baffle plate may be introduced in the secondary combustion zone to increase a combustion chamber temperature, encourage mixing of oxygen starved air with oxygen rich air and increase a residence time of the combustion gas within the combustion chamber. These aspects of the baffle plate promote more efficient burning of the biomass/fuel. Additionally, log lighter(s) may be disposed in the secondary combustion zone to increase a temperature of the combustion chamber for the purposes of reducing harmful emissions. The improved fire grate may be horizontally and vertically adjusted to fit within different sized fireplace combustion chambers.

18 Claims, 10 Drawing Sheets

(56) References Cited

U.S. PATENT DOCUMENTS

| | | | | | |
|---|---|---|---|---|---|
| 4,019,492 | A | | 4/1977 | Rush | |
| 4,078,542 | A | | 3/1978 | Young et al. | |
| 4,122,825 | A | | 10/1978 | Slate | |
| 4,149,517 | A | | 4/1979 | Horwinski | |
| 4,185,611 | A | | 1/1980 | Johnson | |
| 4,203,417 | A | | 5/1980 | Boyd | |
| 4,206,875 | A | | 6/1980 | Grasso | |
| 4,228,784 | A | | 10/1980 | Malafouris | |
| 4,243,015 | A | * | 1/1981 | Trytten | 126/518 |
| 4,310,303 | A | | 1/1982 | Collier | |
| 4,334,517 | A | | 6/1982 | Sweitzer | |
| 4,349,009 | A | | 9/1982 | Patterson et al. | |
| 4,373,505 | A | | 2/1983 | Koziol | |
| 4,445,497 | A | | 5/1984 | Kilday, Sr. | |
| 4,515,147 | A | | 5/1985 | Van Grouw et al. | |
| 4,535,752 | A | | 8/1985 | Cagle | |
| 4,672,946 | A | | 6/1987 | Craver | |
| 4,876,972 | A | | 10/1989 | Mrklas | |
| 5,113,843 | A | | 5/1992 | Henry et al. | |
| 5,179,933 | A | | 1/1993 | McCrillis et al. | |
| 5,263,471 | A | | 11/1993 | Shimek et al. | |
| 5,322,052 | A | | 6/1994 | McCrillis et al. | |
| 5,341,794 | A | | 8/1994 | Henry et al. | |
| 5,722,389 | A | * | 3/1998 | Cranberg | 126/540 |
| 5,850,830 | A | | 12/1998 | Smith | |
| 5,934,270 | A | | 8/1999 | Kim | |
| 5,983,890 | A | | 11/1999 | Thomas et al. | |
| 6,405,724 | B1 | * | 6/2002 | Richard | 126/540 |
| 6,484,714 | B1 | | 11/2002 | Smith | |
| 6,688,302 | B2 | | 2/2004 | Henry et al. | |
| 7,047,962 | B2 | | 5/2006 | Henry et al. | |
| 7,216,645 | B2 | | 5/2007 | Henry et al. | |

OTHER PUBLICATIONS

Wikipedia, "Fireplace", http://en.wikipedia.org/wiki/Fireplace, 3 pages, Oct. 17, 2009.

Achoo! Allergy & Air Products, "Wood-Burning Fireplaces & Air Pollution", http://www.achooallergy.com/fireplace-air-pollution.asp, 2 pages.

Carter, Tim/Ask the Builder, "Fireplace Design & Dimensions", http://www.askthebuilder.com/B110_Fireplace_Design_Dimensions.shtml, 7 pages.

The Brick Industry Association, "Technical Notes 19A—Residential Fireplaces, Details and Construction", Rev (May 1980), Reissued Aug. 2000, http://www.gobrick.com/BIA/technotes/t19a.htm.

The Brick Industry Association, "Technical Notes 19—Residential Fireplace Design", Jan. 1993, http://www.gobrick.com/BIA/technotes/t19.htm, 14 pages, Jan. 1993.

* cited by examiner

FIRE GRATE FOR ENHANCED COMBUSTION WITH VERTICAL AND HORIZONTAL EXPANSION SLEEVES

CROSS-REFERENCE TO RELATED APPLICATIONS

This application is a continuation of U.S. patent application Ser. No. 12/620,453, filed Nov. 17, 2009 now abandoned, which is a continuation-in-part application of U.S. patent application Ser. No. 12/501,869, filed Jul. 13, 2009 now abandoned, the entire contents of which is expressly incorporated herein by reference.

STATEMENT RE: FEDERALLY SPONSORED RESEARCH/DEVELOPMENT

Not Applicable

BACKGROUND

The improved fire grate for enhanced combustion relates to an apparatus for improving efficiency of a fireplace in relation to reduction in harmful emissions and/or heating a room.

A fireplace is a structure to contain a fire for heating. The fire is contained within a firebox which defines a combustion chamber. A chimney or other flue directs combustion gas to the environment. Studies have shown that fireplaces produce a significant amount of emissions (e.g., particulate, carbon monoxide, volatile organic compounds, etc.) that is harmful to humans and the environment. These harmful emissions rise up with the combustion gas and escape through the chimney to the environment.

There are three time honored principles to good combustion. They relate to time, temperature and turbulence. Time is residence time or the amount of time combustion gas remains within the combustion chamber. The longer the combustion gas stays within the combustion chamber, the more complete the combustion process and harmful emissions are reduced. Temperature relates to the temperature within the combustion chamber. The higher the temperature, the better and efficient the burn. As such, there are less harmful emissions. Turbulence relates to the amount of air mixing occurring within the combustion chamber. During operation of the fireplace, the biomass/fuel being burned consumes oxygen in the surrounding area. Fresh air is introduced into the combustion chamber through the fireplace opening. Stratified columns of fresh oxygen rich air rise up in the combustion chamber along side the starved combustion gases. The harmful emissions contained within the oxygen starved combustion gases do not come into contact with the oxygen rich air. Turbulence promotes mixing of the stratified layers or columns of fresh oxygen rich air with the oxygen starved air to encourage a cleaner burn and reduce harmful emissions.

The biomass/fuel being burned produces harmful emissions because the residence time of the combustion gas in the combustion chamber may be too short to allow the biomass/fuel to completely combust. Additionally, the biomass/fuel being burned may not completely combust because the temperature within the combustion chamber may be too low. Moreover, during the combustion process of the biomass/fuel, oxygen in the surrounding area of the biomass/fuel is consumed thereby producing oxygen starved combustion gases. These oxygen starved combustion gases rise, containing the harmful emissions, up through the combustion chamber into the chimney and out into the environment in a vertical column.

BRIEF SUMMARY

The improved fire grate addresses the needs of reducing harmful emissions discussed above, discussed below and those that are known in the art.

The improved fire grate may be disposed within a combustion chamber of a conventional fireplace. The conventional fireplace defines a single combustion zone. The improved fire grate creates two combustion zones, a primary and secondary combustion zone. This primary combustion zone is at the lower portion of the combustion chamber. The primary combustion zone is the part of the combustion chamber in which the biomass/fuel is being burned. During combustion or burning of biomass/fuel, combustion gases will rise up due to convection (i.e., rising hot air). Any harmful emissions (e.g., particulate matter, carbon monoxide, etc.) may float or be contained within that combustion gas stream.

The improved fire grate comprises a hollow tubular conduit that routes fresh oxygen rich air into the combustion chamber and releases the fresh oxygen rich air in a secondary combustion zone of the combustion process. The secondary combustion zone is above the primary combustion zone within the combustion chamber. The hollow tubular conduit may bring fresh oxygen rich air from the room through the fireplace opening or from any reliable oxygen rich air source. The hollow tubular conduit may be routed to the back of the fireplace up and over the biomass/fuel. The hollow tubular conduit may have a plurality of air apertures for releasing the fresh oxygen rich air into the secondary combustion zone where it generally has less oxygen compared to the primary combustion zone.

The hollow tubular conduit may define an upper frame comprised of a plurality of hollow tubes. These tubes may be configured to cover a substantial area of the combustion chamber over the biomass/fuel. By way of example and not limitation, first and second tubes may be generally parallel and be placed at the front and rear of the combustion chamber. Side tubes may be in fluid communication with the front and rear tubes. One or more of the first tube, second tube and side tubes may have air apertures which permit the air brought in from the fresh oxygen rich air source to be introduced into the secondary combustion zone of the combustion chamber. The fresh oxygen rich air is introduced into the secondary combustion zone since the secondary combustion zone will typically have less air or oxygen. The air or oxygen resident within the fireplace was partially consumed during the burning process in the primary combustion zone. The combustion gas that rises above the fuel source into the secondary combustion zone is oxygen starved. The fresh oxygen rich air introduced into the secondary combustion zone via the hollow tubular conduit provides an additional source of fresh oxygen rich air to assist in the completion of the burning process for the incompletely combusted harmful emissions. As the fresh oxygen rich air is routed from the fresh oxygen rich air source to the upper frame, the fresh oxygen rich air may be preheated prior to introduction in the secondary combustion zone to maintain the temperature at the secondary combustion zone. This is accomplished by routing the hollow tubular conduit from the fireplace opening, back to the rear of the combustion chamber, and up to the secondary combustion zone. The hollow tubular conduit is exposed to the heat in the combustion chamber.

In addition to supplying fresh oxygen to the secondary combustion zone of the combustion chamber, a baffle plate may be disposed over the biomass/fuel to be burned. The baffle plate interrupts the flame path rising up from the biomass/fuel being burnt in the sense of velocity, direction and turbulence. The interruption of the flame path encourages larger incompletely burned harmful particulate to fall out of the combustion gas stream and may be reentrained in the combustion gas stream at an earlier point and rise back up toward the baffle plate. This allows the harmful particulate to stay within the flame path for a longer period of time (i.e., longer residence time) and promotes more complete combustion thereby reducing harmful emissions. There are generally less harmful particulate, the more time the particulate stays within the combustion chamber. Also, a more complete combustion is promoted thereby reducing harmful emissions. The baffle plate may be fabricated from a refractory material or another material having good insulation characteristics. As such, the baffle plate increases the temperature at the secondary combustion zone as well as the primary combustion zone to promote complete burning of the harmful particulate matter. It is also contemplated that the baffle plate may have a lower surface formed with a plurality of channels or other groove shapes to interrupt the flow of gas flowing up from the fuel source to the chimney. The channels or grooves formed in the lower surface of the baffle plate may be configured to route the combustion gas stream toward the sides of the baffle plate. When the gas stream from the sides of the baffle plate and the gas stream from the front of the baffle plate recombines above the baffle plate, turbulence may occur which promotes mixing of oxygen rich air with the oxygen starved air.

The baffle plate may also be tilted in the forward direction. Provided that the baffle plate also has good emissivity characteristics, the forward tilt may redirect heat from the burning biomass/fuel into the room to be heated. This may also allow the improved fire grate with enhanced combustion to be utilized in a zero clearance fireplace as well as a masonry fireplace. The baffle plate may optionally be disposed slightly forward of the fuel source to allow flames from the fuel source to rise up behind the baffle plate. This further splits up the gas stream such that the recombined gas streams above the baffle plate may be more turbulent and promote mixing of oxygen starved and oxygen rich air.

Optionally, a log lighter may be disposed in the primary combustion zone and below the biomass/fuel to be burned. This log lighter aids in rapid ignition of the biomass/fuel. The log lighter may be turned off after the biomass/fuel starts its burning process. However, it is also contemplated that the log lighter may be left on to promote efficient burning of the fuel source. Other log lighters may be disposed at other areas within the combustion chamber. By way of example and not limitation, one or more log lighters may be disposed in the secondary combustion zone of the combustion chamber. As discussed above, the baffle plate redirects the combusted gas stream having harmful emissions therein. The log lighter disposed in the secondary combustion zone may increase temperature in the secondary combustion zone. The increased temperature aids in completing the burning process of the biomass/fuel and reducing harmful emissions.

The improved fire grate provides for a unique and efficient supplement to any existing fireplace.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
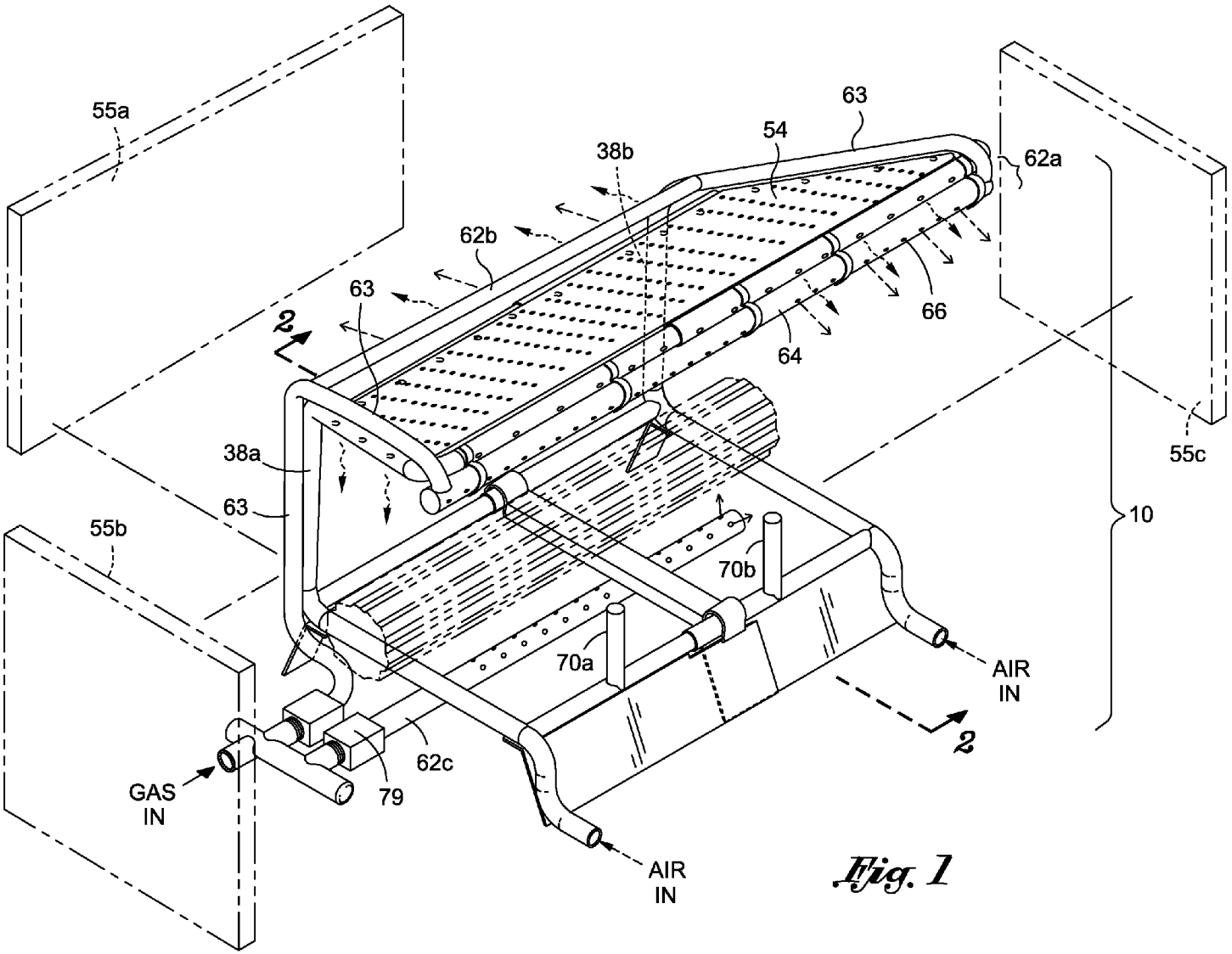
FIG. 1 is a perspective view of an improved fire grate.

Referring now to the drawings, an improved fire grate 10 for enhanced combustion is shown. The improved fire grate 10 may be disposed within a combustion chamber 12 (see FIG. 2) of a fireplace 14. The improved fire grate 10 introduces oxygen rich air to a secondary combustion zone 50 of the combustion chamber 12, retains heat within the combustion chamber 12 to increase a temperature of the combustion chamber 12, encourages mixing of oxygen rich air with oxygen starved combustion gas stream, and increases residence time of the combustion gas stream for the purpose of reducing harmful emissions during fireplace use.

Figure 3:
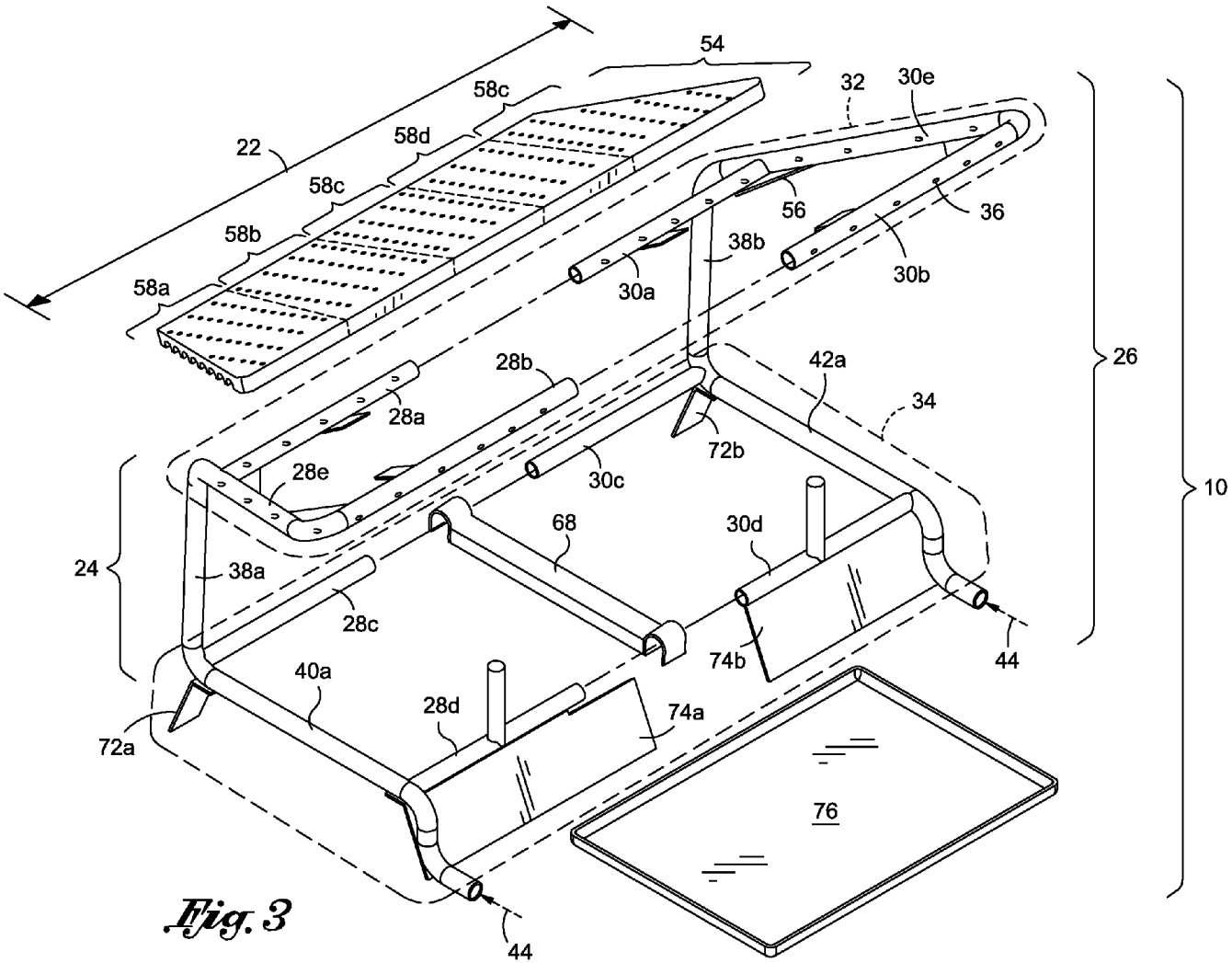
FIG. 3 is an exploded perspective view of the improved fire grate shown in FIG. 1.

Referring now to FIG. 3, an exploded view of the improved fire grate 10 is shown. The improved fire grate 10 may be fabricated from a tubular design made from a cost effective material (e.g., steel, aluminum ceramics, etc.) of appropriate temperature and chemical resistance characteristic. The fire grate 10 may have an adjustable width 22. To this end, the improved fire grate 10 may have a first side 24 and a second side 26. The first side 24 may have a plurality of tubes 28*a-d* which are slidably insertable into tubes 30*a-d* of the second side 26 of the improved fire grate 10. The tubes 28*a-d* telescope into and out of the tubes 30*a-d*. More particularly, the tubes 28*a, b, c, d* may be insertable into tubes 30*a, b, c, d*, respectively. The tubes 28*a-d* may have a frictional fit with tubes 30*a-d* such that once the tubes 28*a-d* are inserted into tubes 30*a-d*, they 28*a-d* and 30*a-d* are set and do not need further adjustment to fit the combustion chamber 12. The installer adjusts the width 22 such that the first and second sides 24, 26 fill a substantial area of the combustion chamber 12. Alternatively, the first and second sets of tubes 28*a-d* and 30*a-d* may be fixed in relation to each other through a pin, setscrew or other means known in the art.

Additionally, the improved fire grate 10 may have an adjustable height. To this end, vertical tubes 38*a, b* may be telescoping and set to a height to fit within the combustion chamber 12. The telescoping length of the tubes 38*a, b* may be set by friction fit, pin, set screw or other means known in the art.

Figure 2:
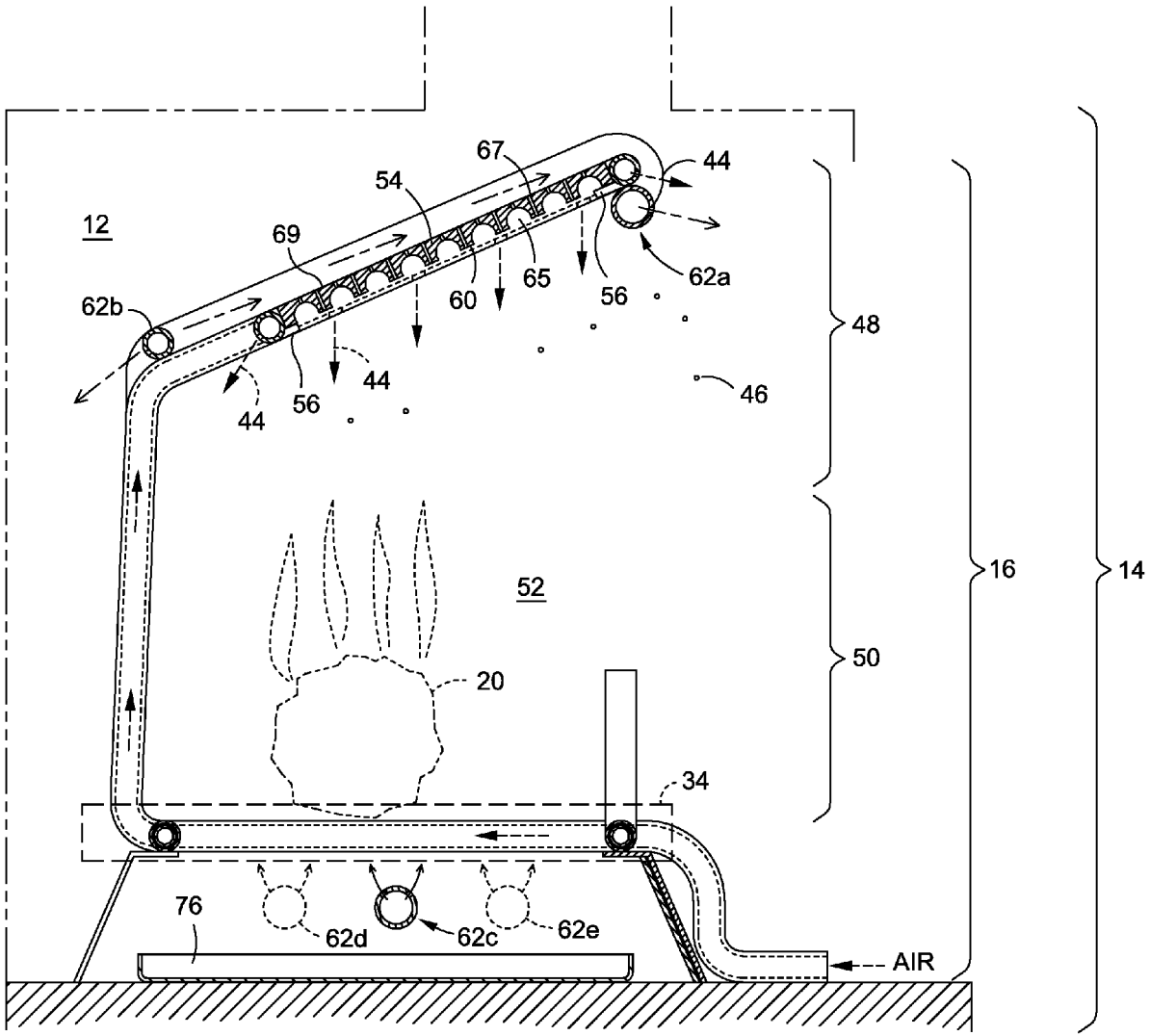
FIG. 2 is a cross sectional view of the improved fire grate shown in FIG. 1.

The improved fire grate 10 may have an upper frame 32 and a lower frame 34. The upper frame 32 may comprise the tubes 28*a, b* and 30*a, b* but also hollow tubes 28*e* and 30*e* which may be splayed to fit the general configuration of combustion chambers 12 of modern fireplaces 14 and/or to provide better cover of the burning biomass/fuel 20. One or more of the tubes 28*a, b, e* and 30*a, b, e* may have a plurality of air outlet holes 36 which introduces fresh oxygen rich air above the biomass/fuel 20, as shown in FIG. 2. The air outlet holes 36 may be formed to direct air down toward the biomass/fuel 20, and/or out toward the outer periphery of the upper frame 32 and/or inward toward the inner periphery of the upper frame 32. Fresh oxygen rich air 44 may be supplied to the upper frame 32 and out of the air outlet holes 36 via tubular supports 38*a, b* (see FIG. 3) and an airflow path through the tubes 40*a* and 42*a* (see FIG. 3) of the lower frame 34.

During operation, fresh air or oxygen 44 may enter through the tubes 40*a*, 42*a* of the lower frame 34 through induction (convection), forced airflow (e.g., blower), or other means known in the art. If via induction, the fire in the combustion chamber 12 heats up the tubes 38*a*, 38*b*, 40*a*, 42*a*, and the upper frame 32. Since hot air rises, the heat air rises through the tubes 38*a*, 38*b*, 40*a*, 42*a*, and the upper frame 32 and out of the air outlet holes 36. The fresh oxygen rich air 44 may be taken from the bottom front of the fireplace 14 or another fresh air source. The fresh oxygen rich air 44 flows through the tubes 40*a*, 42*a* and up through the tubular supports 38*a, b*. The fresh oxygen rich air 44 may be distributed throughout the tubular structure of the upper frame 32 and exit out of the air outlet holes 36 formed in one or more of the tubes 28*a, b, e* and 30*a, b, e*. As the fresh oxygen rich air 44 flows through the tubular structure 38, 40*a*, 42*a*, the fresh oxygen rich air 44 is preheated prior to being introduced into a secondary combustion zone 48 of the combustion chamber 12 (see FIG. 2) to maintain the higher temperature within the combustion chamber.

Initially, the biomass/fuel 20 is burned in a primary combustion zone 50 (see FIG. 2), namely, at the biomass/fuel 20. As the biomass/fuel 20 burns, the combustion process consumes both the biomass/fuel 20 as well as the surrounding oxygen 52. As the biomass/fuel 20 burns, some of the biomass/fuel 20 does not completely burn and rises as a of the combustion gas stream which includes harmful emissions such as particulate matter 46. Since hot air rises, the particulate matter 46 rises along with the rising combustion gas stream into the secondary combustion zone 48 where the particulate 46 comes into contact with fresh oxygen rich air 44 introduced into the secondary combustion zone 48 of the burning process via the upper frame 32. The introduction of fresh oxygen rich air 44 at the secondary combustion zone 48 assists to further the burning process to mitigate release of harmful emissions into the environment. Beneficially, oxygen rich air exits out of the holes 36 (see FIG. 3) in a location (i.e., secondary combustion zone of the combustion chamber) which is oxygen starved to complete the combustion and reduce harmful emissions. As discussed herein, the combustion gas stream may contain columns or stratified columns of oxygen starved air as well as oxygen rich air. The location of the holes 36 may be placed at a location where oxygen starved air is expected.

Referring back to FIG. 1, a baffle plate 54 having good insulating characteristics may be disposed about the inner periphery of the upper frame 32. By way of example and not limitation, the baffle plate 54 may be fabricated from a refractory material. As shown in FIG. 3, the inner periphery of the upper frame 32 may have a plurality of tabs 56 to hold up the baffle plate 54 within the inner periphery of the upper frame 32. In the event that the improved fire grate 10 has an adjustable width 22, the improved fire grate 10 may be provided with a plurality of baffle plate slabs 58*a-e* such that the appropriate slabs 58*a-e* may be fitted to the width 22 of the improved fire grate 10. The slabs 58*a-e* are shown in FIG. 3. The baffle plate 54 may be tilted in the forward direction, as shown in FIG. 2. This is to aid in reflecting heat out through the fireplace opening 16. More particularly, the lower surface 60 of the baffle plate 54 may face the fireplace opening 16 to accomplish the reflection of heat through the fireplace opening 16. The baffle plate 54, as discussed above, may have good insulating characteristics. As such, the baffle plate 54 may also increase the temperature in the secondary combustion zone 48 of the combustion chamber 12 to further encourage the combustion process and reduce harmful emissions. The increased heat in the secondary combustion zone 48 caused by the baffle plate 54 aids in the burning process of the harmful emissions in the secondary combustion zone 48 as well as in the primary combustion zone 50 to reduce harmful emissions into the atmosphere.

It is also contemplated that additional optional baffle plates 55*a, b, c* may be disposed at other areas of the improved fire grate 10, as shown in FIG. 1. By way of example and not limitation, a baffle plate 55*a* may be attached to the rear side of the improved fire grate 10 at tubes 38*a, b*. The baffle plate 54 attached to these tubes 38*a, b* may extend from the lower frame 34 to the upper frame 32 to increase a temperature within the primary combustion zone 50 and the secondary combustion zone 48. Additional baffle plates 55*b, c* may be lined on the sides of the improved fire grate 10 that extends from tubes 40*a*, 28*e* and 42*a*, 30*e*. These additional baffle plates 55*a, b, c* as well as baffle plate 54 also aid in maintaining or increasing the temperature at the primary combustion zone 50 and the secondary combustion zone 48 and promote more efficient combustion of the biomass/fuel 20. The baffle plates 55*a, b, c* may be attached to the fire grate 10 via adhesives, nut and bolts and/or other attachment methods known in the art.

The baffle plate 54 increases gas residence time of the combustion gas in the primary and secondary combustion zones 50, 48 thereby encouraging or promoting more complete combustion of the biomass/fuel 20 and reduction of harmful particulate. Additionally, the flame produced by the fuel source 20 may impinge the baffle plate 54. As a result, larger particulate 46 may drop out of the combustion gas stream back toward the primary combustion zone 50 and reenter the combustion gas stream. The residence time of the larger particulate 46 in the combustion gas stream is increased which provides additional time for the larger particulate 46 to complete its combustion process.

The baffle plate 54 also prevents the combustion gas from going straight up through the chimney but rather provides a barrier to provide a circuitous flame path around the baffle plate 54. Since the natural vertical flame path is interrupted, mixing of oxygen rich air with oxygen starved air is encouraged. Additionally, since the length of the flame path is now increased, residence time of the combustion gas in the primary and secondary combustion zones 50, 48 is increased to promote more complete combustion and reduction of harmful emissions. Additionally, since the baffle plate 54 is tilted forward, the gas as well as the particulate 46 following such combusted gas stream is re-directed to the front of the improved fire grate 10 at the upper frame 32 where oxygen 44 is introduced to encourage more complete combustion and to reduce harmful emissions (e.g., particulate matter, carbon monoxide, etc.). It is contemplated that the baffle plate 54 may optionally be disposed slightly forward of the fuel source 20 such that a portion of the flames and combustion gas proceeds past the back of the baffle plate 54. Please note that the fresh oxygen rich air 44 may also be supplied to the back side via tubes 28*a*, 30*a* to aid in combustion of the such combustion gas and particulate.

Referring back to FIG. 2, the lower surface 60 of the baffle plate 54 may have channels 65 that extend horizontally from left to right. These channels may have a semicircular concave configuration as shown in FIG. 2 but other configurations (e.g., vertical, diagonal, etc.) are also contemplated. The channels 65 promote the gas to flow toward the perimeter (e.g., sides) of the improved fire grate 10. The combustion gas may be divided into two or more flame paths, namely, a portion of the combustion gas may proceed forward and around the front edge of the baffle plate 54. The combustion gas may flow outward toward the sides of the baffle plate 54 and around the baffle plate 54 to join up with the combustion gas that flowed past the front edge of the baffle plate 54. The separation and recombination of these flame paths encourage mixing of air above the baffle plate 54. A portion of the combustion gas stream may pass the rear edge of the baffle plate. This increases mixing action, increases particulate drop out and residence gas time within the primary and secondary combustion zones 50, 48. Alternatively, the channels 65 may extend vertically to route combustion gas to the front side of the upper frame 32. Additionally, through holes 67 may be formed through the baffle plate 54 that extend from the lower surface 60 and/or channels 65 to the upper surface 69 for the purposes of encouraging particulate removal and mixing of oxygen rich air with the oxygen starved air.

Referring now back to FIGS. 1 and 2, one or more fire sources 62 may be disposed at select locations within the secondary combustion zone 48. The fire sources 62 may be an elongate tube 64 with a plurality of holes 66 that may be directed outward. These elongate tubes 64 with holes 66 are supplied with combustible gas such as propane, natural gas, etc. via a system of tubes from a gas source. By way of example and not limitation, the fire sources 62 may be a log lighter sold under the trademark BLUE FLAME. The fire source 62*a* is shown in FIGS. 1 and 2.

Figure 9:
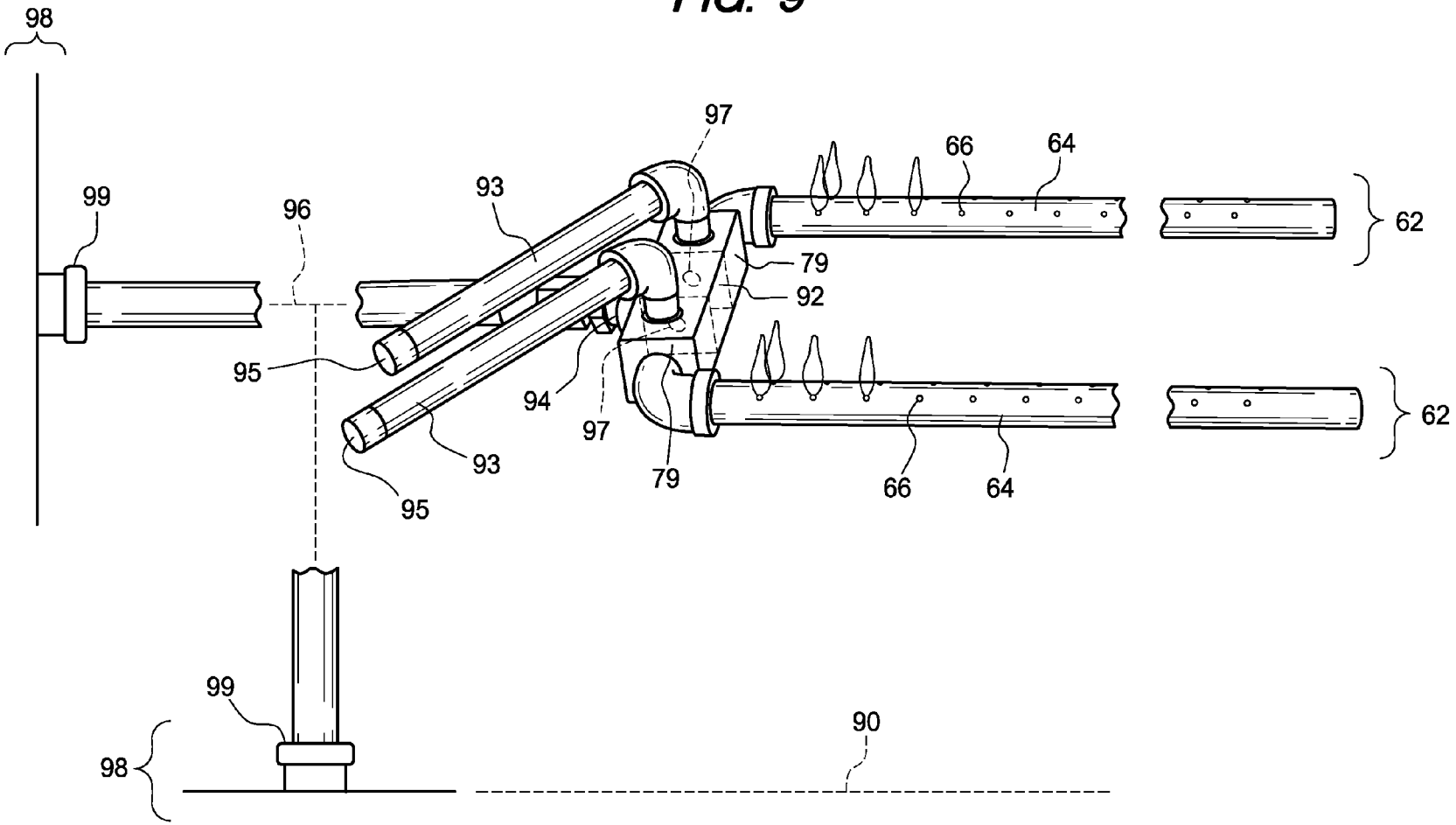
FIG. 9 is a perspective view of two fire sources connected to a first embodiment of a mixing chamber.
Figure 10:
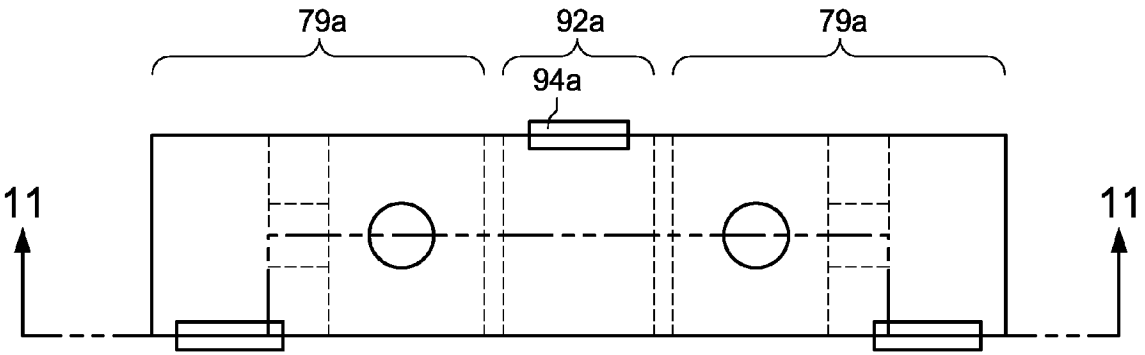
FIG. 10 is a top view of a second embodiment of a mixing chamber.

Referring now to FIG. 9, two fire sources 62 may be disposed below the fire grate 10 (not shown for purposes of clarity). Each of the fire sources 62 may be in fluidic communication with one mixing chamber 79. Each of the mixing chambers 79 may be in fluidic communication with a manifold 92. The manifold 92 may have a flammable gas inlet 94 for receiving flammable gas via a conduit 96 connected to a flammable gas source 98. The fire sources 62 may have elongate tubes 64 with either aligned or straight holes 66 or staggered holes 66 as discussed herein. Each of the mixing chambers 79 may have an air conduit 93 that has an inlet 95 that is either directed to the side or downward. The inlet 95 receives air and introduces air into the mixing chamber. The mixing chambers 79 are in fluid communication with the manifold 92 by way of an orifice 97. The manifold 92 introduces flammable gas into the mixing chamber 79. Accordingly, the mixing chambers 79 mix air with flammable gas and introduce the mixed flammable gas/air into the elongate tubes 64. At the mixing chamber, the mixture of flammable gas and air is combustible. The air conduits 93 prevent embers or an ignition source from falling into the mixing chamber 79 and inadvertently igniting the flammable mixture in the mixing chamber 79 prior to entrance into the elongate tubes 64. As discussed above, the fire sources 62 are disposed below the fire grate 10. As such, the mixing chambers 79 are disposed closely adjacent to the biomass/fuel 20 being burned. Embers from the biomass/fuel source 20 may fall into the mixing chambers 79 without the air conduits 93. The air conduits 93 may have an elongate nature and the inlets 95 may be disposed away (e.g., distanced away, oriented sideways, oriented downward, etc.) from the biomass/fuel source 20. Falling embers hit the air conduits 93 and do not enter the mixing chambers 79.

Referring still to FIG. 9, the fire sources 62 may be disposed in an optimal position with respect to the fire grate 10. In particular, the flammable gas source 98 may have a half inch connection. A reducer 99 (e.g., ½" to as small as ¼") may be connected to the flammable gas source 98. The reduced sized conduit 96 (e.g., flex tubing, copper tubing, etc.) may be bent or shaped and connected to the flammable gas inlet 94 of the manifold 92. Accordingly, after the fire sources 62 are optimally placed with respect to the fire grate 10, the conduit 96 allows the fire sources 62 to remain in the optimal position, regardless of the position of the flammable gas source 98 on a vertical wall or a ground 90. Regardless of the left to right position or front to back position of the fire sources 62 as well as the vertical position of the flammable gas source 98, the bendable conduit 96 allows the fire sources 62 to be placed optimally with respect to the fire grate 10.

It is also contemplated that one mixing chamber 79 may be in fluid communication and control combustible gas flow to two or more fire sources 62.

Flammable gas (e.g., propane, natural gas, etc.) may be routed to the fire sources 62*a, b* via pipes 63 (see FIG. 1). During operation of the fireplace 14, the user may ignite the gas flowing out of the holes 66 of the elongate tube 64. The rapid ignition and additional heat increases the temperature in the primary combustion zone 50 to reduce harmful emissions and support additional combustion of flue gases. Additional fire sources 62 may also be disposed within the secondary combustion zone 48 such as at the rear (see fire source 62*b* in FIG. 1) of the combustion chamber 12 as well as the sides (not shown) of the combustion chamber 12. The BTU rating, location and flame hole distribution is to be determined based on test results. The fire sources 62 in the secondary combustion zone are optional.

The lower frame 34 may have a similar construction as that compared to the upper frame 32. The lower frame 34 may be fabricated from telescoping tubes 28*c* and 30*c* as well as telescoping tubes 28*d* and 30*d*. These respective tubes may have a frictional fit to fix the width 22 of the improved fire grate 10. It is contemplated that the tubes 28*c, d* and tubes 30*c, d* may or may not be in fluid communication with tubes 38*a*, 40*a* or tubes 38*b*, 42*a*. Fresh oxygen rich air 44 may flow through tubes 40*a*, 42*a*, 38*a* and 38*b* up to the upper frame 32. A crossbar 68 may be disposed over the tubes 28*c*, 30*c* and 28*d*, 30*d*. The biomass/fuel 20 may be laid across tube 40*a*, crossbar 68 and tube 42*a* to raise the biomass/fuel 20 above the ground. The tubular supports 38*a, b* along with retaining pipes 70*a, b* retain the biomass/fuel 20 on the lower frame 34. Two legs 72*a, b* may be attached (e.g., tack welded) to tubes 40*a*, 42*a*. Baffle plate 74*a, b* may be attached (e.g., tack welded or other means) to the tubes 28*d*, 30*d* to provide leg support at the front of the improved fire grate 10. The baffle plate 74*a, b* may also be fabricated from a refractory material or other material having good insulation characteristics. The baffle plates 74*a, b* may overlap one another and provide a semi-enclosed space behind the baffle plates 74*a, b* during operation, as shown in FIG. 1. The baffle plates 74*a, b* directs airflow coming through the fireplace opening 16 up and into the primary combustion zone 50 of the combustion chamber.

Figure 4A:
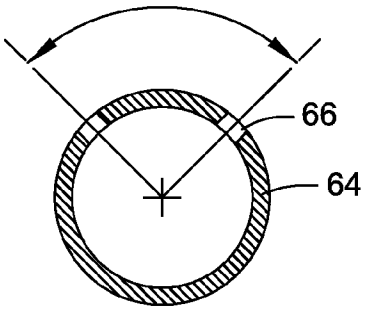
FIG. 4A is cross sectional view of an elongate tube of the log lighter shown in FIG. 4.
Figure 4:
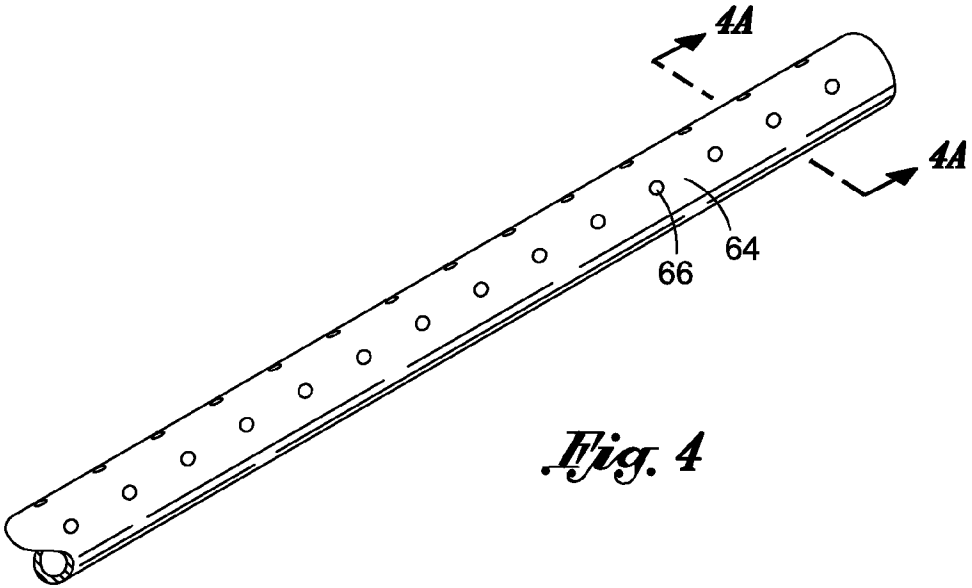
FIG. 4 is an enlarged view of a log lighter shown in FIG. 1 having aligned holes.
Figure 5:
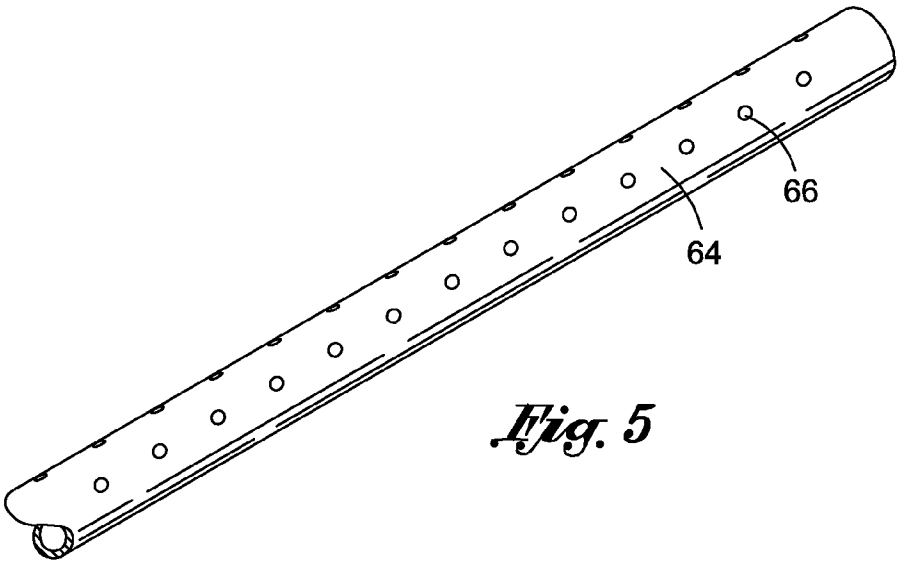
FIG. 5 is an alternate embodiment of the log lighter having staggered holes.

A fire source 62*c* may also optionally be disposed below the lower frame 34, as shown in FIG. 2. The fire source 62*c* may be an elongate tube 64 with a plurality of holes 66, as shown in FIGS. 4-5. The elongate tubes 64 may have a hollow configuration to allow gaseous fuel (e.g., propane, natural gas, etc.) to flow through the elongate tube 64 and out of the holes 66. This fire source 62*c* provides for rapid initial ignition of the biomass/fuel 20 and may be left on to supplement the combustion process for the entire time the biomass/fuel 20 is being burned to maintain a more efficient burning state. The additional fire source 62 assists in bringing new unburnt biomass/fuel (e.g., wood logs) to an efficient burning state. The holes 66 may be aligned (i.e., straight) to each other along a longitudinal length of the elongate tubes 64. These holes 66 may be oriented vertically upwards. Alternatively, the holes 66 may be staggered as shown in FIG. 5 along the length of the elongate tubes 64. The holes 66 may also be at a ninety (90) degree angle with respect to each other as shown in FIG. 4A and be directed in the generally upward direction as shown in FIG. 2. The fire source 62*c* may be disposed centrally below the lower frame 34 as shown in FIG. 2. It is also it is contemplated that two (2) fire sources 62*d, e* may be disposed below the lower frame 34 evenly distributed there below. The fire sources 62*a, b* disposed in the second stage 48 of the combustion chamber 12 may have the same configuration (e.g., straight, outwardly angled) as the fire sources 62*c-e*. The additional fire sources 62*c-e* and the staggered and outwardly angled holes 66 (see FIG. 5) of the fire sources 62*c-e* promote even heat distribution under the biomass/fuel 20 being burned.

It is also contemplated that an ash pan 76 may be disposed below the lower frame 34 and the fire source 62*c, d, e*. The ash pan 76 aids in the cleanup of the fireplace 14 after use.

Figure 6:
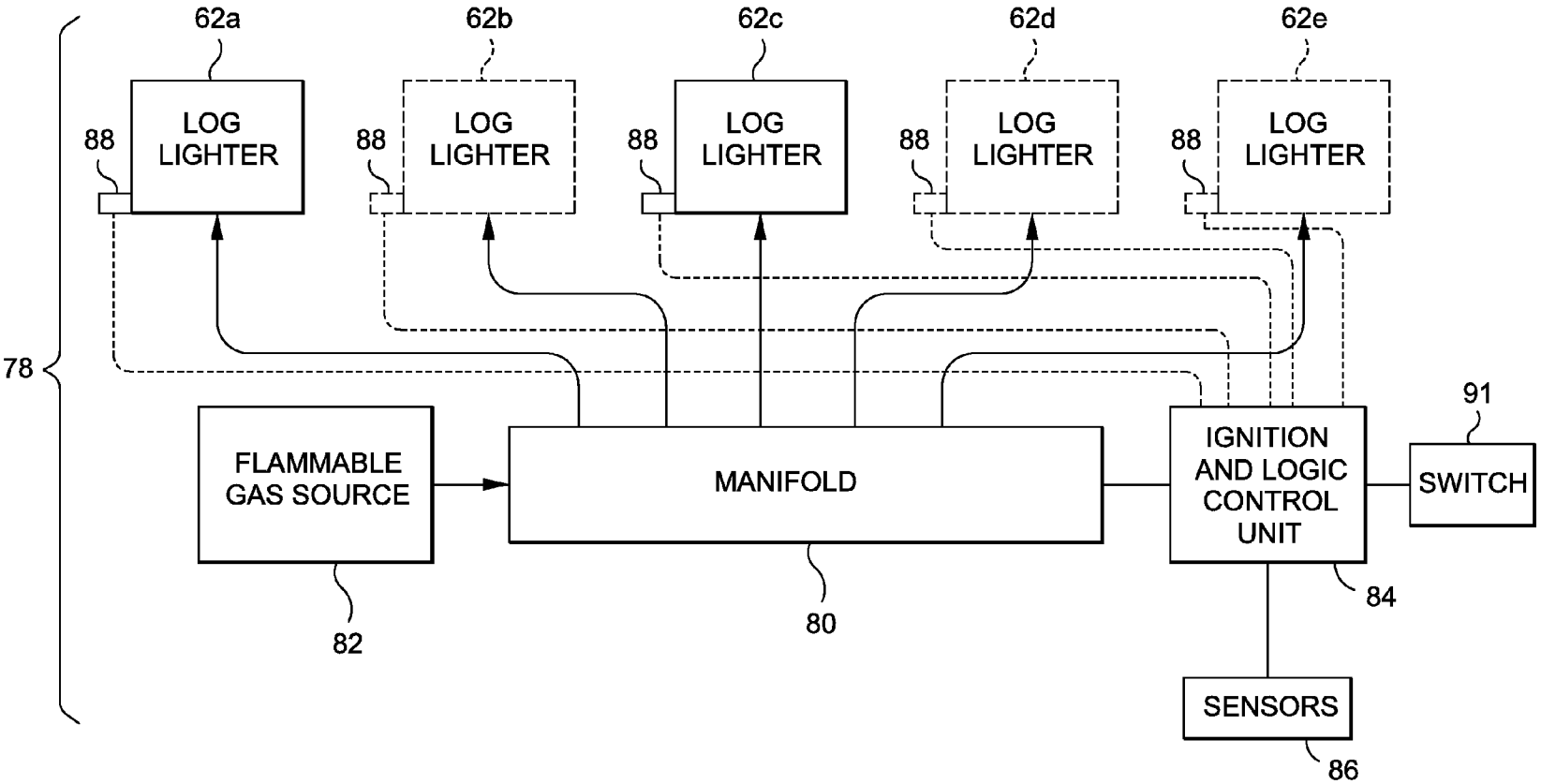
FIG. 6 is a schematic of an ignition system and logic control system.

Referring now to FIG. 6, an ignition system/logic control system 78 is contemplated. The log lighters 62*a, b, c, d, e* disclosed herein may be in fluid communication with a manifold 80 that receives flammable gas (e.g., propane, natural gas, etc.) from a flammable gas source 82. Based on the configuration of the improved fire grate 10 and the placement and number of heat sources 62*a-e* incorporated into the system, an ignition and logic control unit 84 which may be electro-mechanically connected to the manifold 80 opens and closes various valves to supply flammable gas to one or more of the log lighters 62*a-e*. Various sensors 86 (e.g., carbon monoxide sensor, temperature sensor, oxygen sensor, etc.) may be disposed within the combustion chamber 12, the room to be heated, the chimney, or at other various locations within or adjacent the fireplace 14 to measure the efficiency of the fireplace 14. Based on the sensed information, such sensed information may be transmitted to ignition and logic control unit 84 such that the appropriate amount of flammable gas is being supplied to one or more of the log lighters 62*a-e*. To light the log lighters 62*a-e*, an ignition switch 88 may be disposed adjacent the log lighter to provide a spark or initial pilot flame to the log lighter. Based on which log lighters 62*a-e* is to be ignited, the ignition and logic control unit 84 may send a signal to the ignition switch 88 to either start and leave on one or more of the log lighter 62*a-e*. To turn off one or more of the log lighters 62*a-e*, the ignition and logic control unit 84 may shut off supply of flammable gas to that particular log lighter 62*a-e*.

Still referring to FIG. 6, the heat sources 62*a-e* may be controlled by a manual push button switch 91. The user will place biomass/fuel source 20 on the fire grate 10. At this time, the user may push the push button switch 91 to activate the ignition and logic control unit 84. At this time, gas is provided to the pilot and the ignition switch 88 supplies a spark to supply pilot flame. The pilot flame is located at or near the path of flammable gas flow through the holes 66 in the elongate tubes 64. A thermocouple may recognize that the pilot flame is currently lit. Once the pilot flame is lit and recognized, the manifold 92 may feed flammable gas into one or more of the heat sources 62*a-e* as determined by the logic control unit 84. At this time, the pilot flame lights the gas flowing through the holes 66 of the elongate tubes 64 of each of the heat sources 62*a-e*. Once the flame of the heat sources 62*a-e* is recognized by way of a thermocouple or other device, gas to the pilot flame may be terminated. Preferably, the ignition and logic control unit 84 supplies flammable gas to the heat sources 62*a-e* by way of the manifold 80 for a set period of time (e.g., ten (10) minutes) to allow the biomass/fuel source 20 to burn at an efficient state. After this set period of time, the manifold 80 shuts off gas flow to one or more of the fire sources 62*a-e* as desired. By way of example and not limitation, the heat sources 62 disposed below the fire grate 10 are turned off after the set period of time. However, the other heat sources 62 disposed at other areas within the fireplace 14 may remain on to promote efficient burn as discussed herein. The logic control unit 84 may also shutoff gas flow to the heat sources 62*a-e* if a flame is not recognized by way of a thermocouple or other device.

The switch 91 may also have two different settings, namely, a manual setting which the operator must push or activate as discussed above and an automatic setting. In the automatic setting, the above procedure will occur when one or more of the sensor 86 (e.g., temperature) indicates that a condition exists in the fireplace that would benefit from the temporary or long term burning of one or more of the fire sources. By way of example and not limitation, a temperature sensor 86 may indicate a low temperature reading within the fireplace 14. The user may place a biomass/fuel source on the fire grate 10. A sensor 86 may detect the presence of the biomass/fuel source and temporarily turn on one or more of the fire sources 62 disposed below the fire grate 10 and/or the other fire sources 62 disposed at other locations. Conversely, in the automatic setting, the logic control unit 84 may shut off gas flow to one or more of the fire sources 62 when one or more of the sensors 86 indicate efficient burning of the biomass/fuel source 20.

Figure 7:
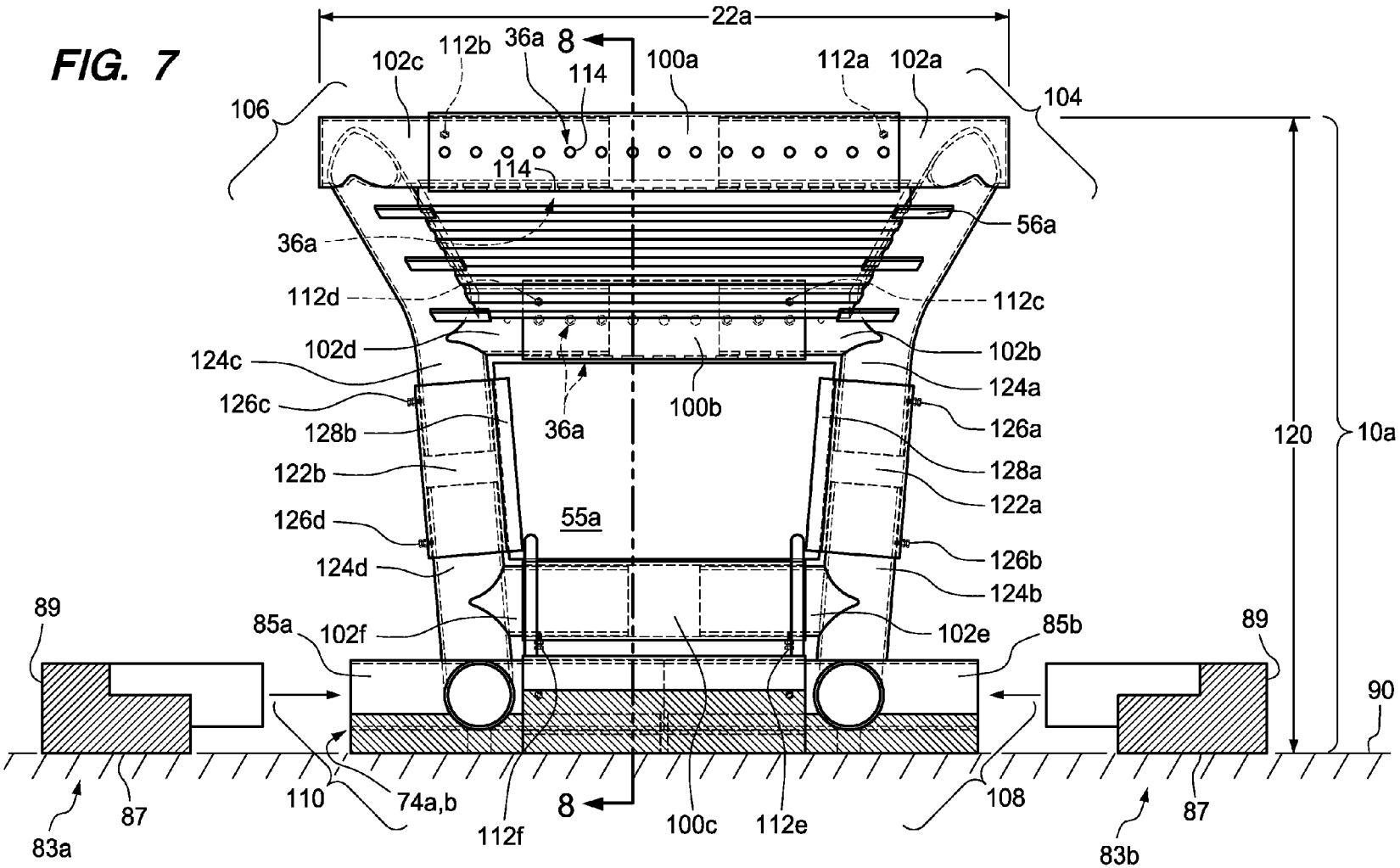
FIG. 7 is a front view of a second embodiment of the improved fire grate.
Figure 8:
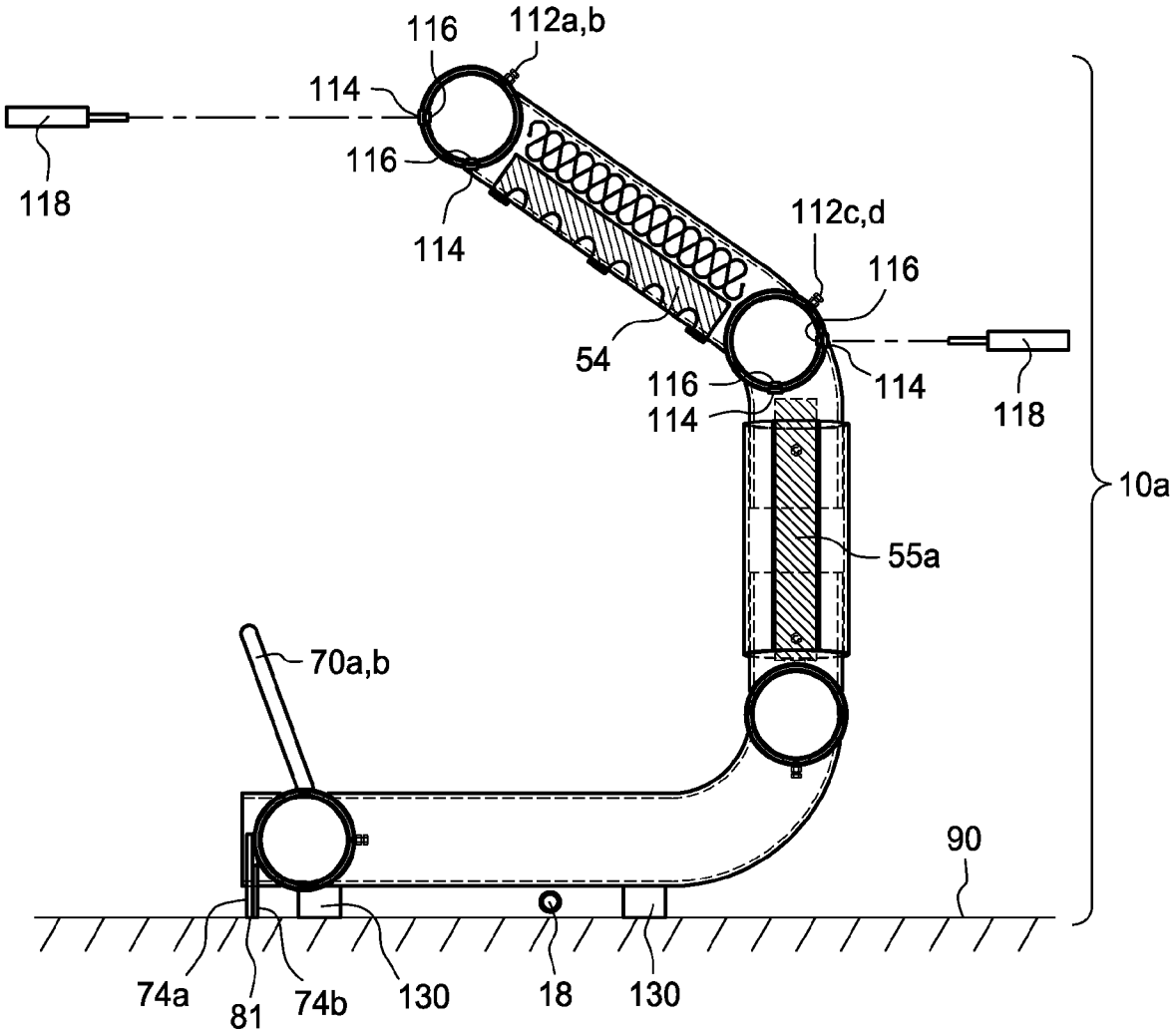
FIG. 8 is a cross sectional view of the improved fire grate shown in FIG. 7.

Referring now to FIGS. 7 and 8, a second embodiment of the improved fire grate 10*a* is shown. The improved fire grate 10*a* may be vertically and horizontally expanded or contracted so as to be sized and configured to fit within one of a plurality of different fireplace sizes. It is contemplated that the improved fire grates 10, 10*a* may be fabricated and provided to the public in a small range size, medium range size and a large range size. The height and width of the improved fire grate 10, 10*a* may be adjusted to fit within the combustion chamber 12 of the fireplace 14.

To this end, the improved fire grate 10*a* may be expandable in the horizontal direction similar to the fire grate 10 discussed above. In particular, the improved fire grate 10*a* may have one or more horizontal expansion sleeves 100*a, b* and *c*. The horizontal expansion sleeves 100*a, b, c* may be sized and configured to snugly receive horizontal tubes 102*a, b* of the upper right section 104 and horizontal tubes 102*c, d* of the upper left section 106 of the improved fire grate 10*a*. The horizontal expansion sleeve 100*c* may be sized and configured to snugly receive horizontal tubes 102*e, f* of the lower right section 108 and lower left section 110 of the improved fire grate 10*a*. The horizontal tubes 102*a-f* may be slid into and out of the horizontal expansion sleeves 100*a-c* to fit the improved fire grate 10*a* horizontally within the combustion chamber 12 of the fireplace 14. Once the width 22*a* of the improved fire grate 10*a* is adjusted to the width of the combustion chamber 12 of the fireplace 14, set screws 112*a, b, c, d* are engaged such that the width 22*a* of the improved fire grate 10*a* does not change during use. In particular, the horizontal expansion sleeves 100*a, b* may have a threaded through hole which receives the set screws 112*a-d*. The set screws 112*a-d* engage the exterior surfaces of the horizontal tubes 102*a-d* such that the horizontal tubes 102*a-d* cannot slide within the expansion sleeves 100*a-b* once set.

The horizontal expansion sleeves 100*a, b* may have holes 114 equidistantly spaced apart from each other (e.g., 1" apart). A first set of holes may be oriented to blow air horizontally forward as shown in FIG. 8. A second set of holes 114 may be oriented to blow air directly downward as shown in FIG. 8. The downwardly directed holes 114 may also be equidistantly spaced apart from each other (e.g., 1"). Moreover, the downwardly directed holes 114 may be offset from the forwardly directed holes 114 (e.g., ½"), as shown in FIG. 7. Holes 114 and 116 may be formed in expansion sleeve 100*b* and horizontal tubes 102*b, d* in a similar fashion as the holes 114, 116 in expansion sleeve 100*a* and tubes 102*a, c*. As shown in FIG. 8, one set of holes 114, 116 are oriented rearward of the improved fire grate 10*a* and one set of holes 114, 116 are oriented downward. When the width 22*a* in the improved fire grate 10*a* is adjusted, the width 22*a* is adjusted by the spacing of the holes 114, 116. In this example, the width 22*a* of the improved fire grate 10*a* is adjustable in 1" increments. The reason is that for air to blow out of the holes 114, 116 which form the air outlet holes 36*a*, the holes 114, 116 must be aligned to each other. To align the holes 114, 116, a pin 118 may be inserted into the holes 114, 116 prior to engagement of the set screws 112*a, b* and 112*c, d*.

Once the width 22*a* of the fire grate 10*a* is set, the horizontal height 120 is adjusted. To this end, the improved fire grate 10*a* may have vertical expansion sleeves 122*a, b*. The upper right section 104 and the lower right section 108 of the improved fire grate 10*a* may have vertical tubes 124*a, b* that are sized and configured to be received within the vertical expansion sleeve 122*a*. Likewise, the upper left section 106 and the lower left section 110 may have vertical tubes 124*c, d* which are sized and configured to be received into the vertical expansion sleeve 122*b*. To adjust the height 120 of the improved fire grate 10*a*, the tubes 124*a-d* are slid into and out of the expansion sleeves 122*a, b* until the appropriate height 120 of the improved fire grate 10*a* is achieved. Preferably, the height 120 of the fire grate 10*a* is sized and configured to fit within the combustion chamber 12 of the fireplace 14. As the tubes 124*a-d* are slid into and out of the vertical expansion sleeves 122*a, b*, the tubes 102*e, f* are also slid into and out of the horizontal expansion sleeve 100*c* since the tubes 124*a-d* are skewed and not parallel with each other. As such, when the width 22*a* of the improved fire grate 10*a* is being adjusted, set screws 112*e, f* are not set. The tubes 102*e, f* are allowed to slide into and out of the expansion sleeve 100*c*. After the height 120 of the improved fire grate 10*a* is adjusted, the set screws 112*e, f* are engaged. Additionally, set screws 126*a-d* are set to prevent movement of the tubes 124*a-d* within vertical expansion sleeves 122*a, b*.

The tubes 102*a-f* may be sized and configured to snugly fit within expansion sleeves 100*a-c*. However, it is also contemplated that the reverse orientation is possible. The expansion sleeves 100*a-c* may be slid into the tubes 102*a-f*. The same is possible with the vertical expansion sleeves 122*a, b*. Also, preferably, there is no more than 1/32" gap between the expansion sleeves 100*a-c* and tubes 102*a-f* as well as between tubes 124*a-d* and expansion sleeves 122*a, b*. For example, the outer diameter of the tubes 102*a-f* and tubes 124*a-d* may be no more than 1/16" smaller than the inner diameter of the expansion sleeves 100*a-c* and vertical expansion sleeves 122*a-b*. It is also contemplated that a fire resistant putty may be disposed about the periphery of the distal ends of the expansion sleeves 100*a, b* and expansion sleeves 122*a, b* prevent leakage of air.

Baffle plate 55*a* may be disposed at the rear of the improved fire grate 10*a*. To this end, a U-channel 128*a, b* may be attached to medial sides of the expansion sleeves 122*a, b*. The baffle plate 55*a* may be slid into the U-channels 128*a, b* to hold the same in place during use. To adjust the width and height of the baffle plate 55*a*, the baffle plate 55*a* may be provided to the consumer in an oversized state. Once the appropriate height 120 and width 22*a* of the improved fire grate 10*a* is achieved, the consumer may cut the baffle plate 55*a* to size. The same is also possible for baffle plates 54 which are suspended via tabs 56*a* (refractory tabs).

Referring now to FIG. 8, baffle plates 74*a, b* (deflector plates) are shown. The baffle plates 74*a, b*, and more particularly, a lower edge 81 of the baffle plates 74*a, b* extend to the ground of the fire box of the fireplace 14 to mitigate air from flowing in front of the baffle plates 74*a, b* to the rear of the baffle plates 74*a, b*. To further mitigate air transfer in front of to the rear of the baffle plates 74*a, b*, baffle plate extensions 83*a, b* (see FIG. 7) may be slid into pipes 85*a, b* and adjusted to overlap the baffle plates 74*a, b*. The lower edges 87 of the baffle plate extensions 83*a, b* may extend to the ground of the fire box to prevent flow of air underneath the baffle plate extensions 83*a, b*. Additionally, the baffle plate extensions 83*a, b* may be extended outwardly such that lateral edges 89 may extend to side surfaces of the fire box of the fireplace 14. As such, the baffle plates 74*a, b* and the baffle plate extensions 83*a, b* form a barrier to prevent flow of air underneath and around the sides of the baffle plates 74*a, b*. The improved fire grate 10*a* may be suspended above the ground via spacers 130 having a height sufficient to allow the heat source 18 between the improved fire grate 10*a* and the ground. Retaining members 70*a, b* are also shown. Referring now to FIG. 8, the set screws 112 are not protruding out of the backside of the improved fire grate 10, 10*a*. As such, the improved fire grate 10, 10*a* may be backed up and contact the backside of the combustion chamber 12.

Figure 11:
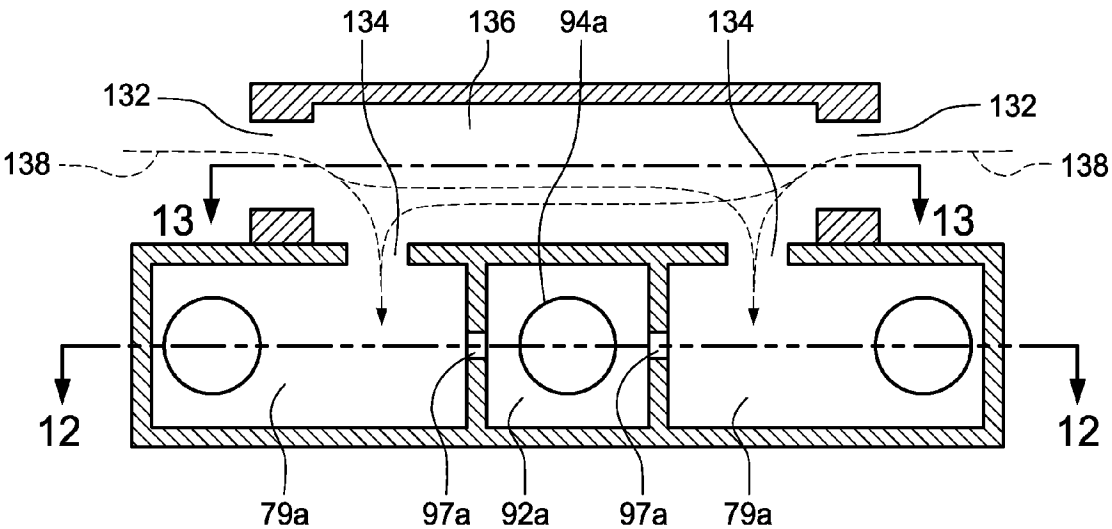
FIG. 11 is a cross sectional view of the second embodiment of the mixing chamber shown in FIG. 10.

Referring now to FIGS. 10-13, a second embodiment of the mixing chamber 79*a* is shown. The two mixing chambers may be in fluid communication with a manifold 92*a* by way of orifices 97*a* (see FIG. 11). Flammable gas is introduced into the manifold 92*a* through flammable gas inlet 94*a*. The flammable gas is then flowed through into the mixing chamber 79*a* which is combined with fresh air through air inlets 132 and 134. The air inlets 132 may be threaded to allow attachment of an air conduit 93 that can be directed toward the front of the fireplace 14 so that fresh air may be flowed into an air chamber 136 (see FIG. 11). In contrast to the embodiment shown in FIG. 9, it is contemplated that one of the two air inlets 132 may be plugged with an air conduit attached to the unplugged air inlet 132. The determination of which air inlet 132 to plug and which air inlet 132 to attach to an air conduit 93 is dependent on the orientation of the mixing chamber 79*a*. Preferably, the unplugged air inlet 132 is directed to a front open space of the fireplace 14. The air conduit 93 may be attached to the unplugged air inlet 132 and may provide fresh air into both of the mixing chamber 79*a* by way of the common air chamber 136. Air flow paths 138 are shown in FIG. 11.

Figure 12:
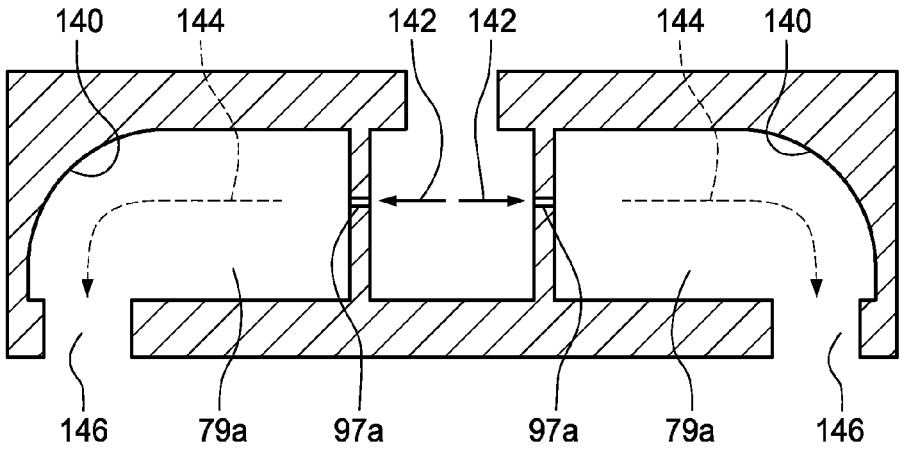
FIG. 12 is a cross sectional view of the second embodiment of the mixing chamber shown in FIG. 11.

Referring now to FIG. 12, the mixing chamber 79*a* may have curved back surfaces 140. As flammable gas flows through the orifices 97*a* in the direction of arrows 142, the flammable gas enters the mixing chamber 79*a* and mixes with fresh air introduced into the mixing chamber 79*a* by way of air inlets 134 (see FIG. 11). The mixed air/flammable gas is flowed through the mixing chamber 79*a* in the direction of arrows 144. The curved back surfaces 140 are optional and are meant to assist in providing less turbulence by guiding the mixture to the mixed flammable gas/air outlets 146 that may be connected to the fire sources 62.

Figure 13:
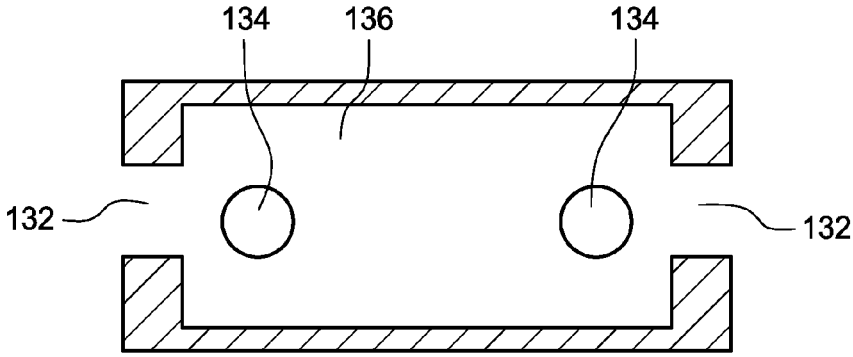
FIG. 13 is a cross sectional view of the second embodiment of the mixing chamber shown in FIG. 12.
Figure 14:
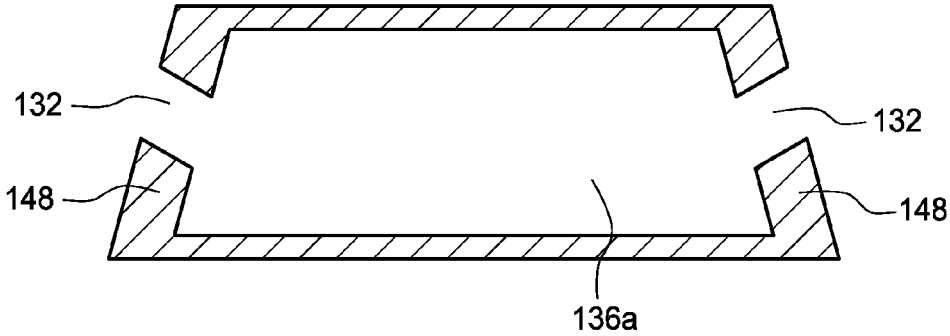
FIG. 14 is an alternate embodiment of an air chamber shown in FIG. 13.

Referring now to FIG. 13, fresh air may enter the air chamber 136 by way of air inlets 132. It is contemplated that one of the air inlets 132 may be plugged while the other air inlet is attached to an air conduit 93. It is also contemplated that both of the air inlets 132 are unplugged with two separate air conduits attached to the air inlets 132. After air enters the air chamber 136 by way of the air inlets 132, the air is introduced into the mixing chamber 79*a* by way of air inlets 134. Referring now to FIG. 14, an alternate embodiment of the air chamber 136 is shown. In particular, air chamber 136*a* may have a trapezoidal configuration. Sidewalls 148 may be skewed so that air conduits 93 that are attached to one or both of the air inlets 132 can be directed toward the side as shown in FIG. 9.

The tubular supports 38*a, b*, vertical tubes 124*a, b* and sleeves 122*a, b* have been shown as being generally round tubes. However, it is also contemplated that these tubes 38*a, b*, 124*a, b*, 122*a, b* may also be square, rectangular or other configurations. A generally flatter rectangular tube will allow the wood to be placed further back on the fire grate.

The above description is given by way of example, and not limitation. Given the above disclosure, one skilled in the art could devise variations that are within the scope and spirit of the invention disclosed herein, including various ways of fixing the width 22 of the improved fire grate after adjustment. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An apparatus for promoting a cleaner burn of fuel within a combustion chamber of a fireplace, the apparatus comprising;

a hollow tubular conduit defining a first end portion in fluid communication with an air source; a second end portion with a plurality of air apertures and a middle portion in fluid communication with the first and second end portions wherein the middle portion supports the second end portion, the second end portion disposable in a secondary combustion zone of the combustion chamber of the fireplace so that the plurality of air apertures are disposed in the secondary combustion zone, the second end portion of the hollow tubular conduit defines an upper frame having first, second, third and fourth hollow tubes in fluid communication with each other, the first and third tubes being generally parallel with each other, the second and fourth hollow tubes being generally parallel to each other such that the upper frame substantially fills the secondary combustion zone of the combustion chamber of the fireplace, the middle portion having fifth and sixth tubes in fluid communication with the upper frame;

first and second horizontal expansion sleeves telescoping with the first and third tubes for adjusting a width of the apparatus to fit a range of combustion chamber sizes;

third and fourth vertical expansion sleeves telescoping with the fifth and sixth tubes for adjusting a height of the apparatus to fit a range of combustion chamber sizes; and a means for flowing air through the hollow tubular conduit from the first end portion to the second end portion through the air apertures for introducing oxygen to the secondary combustion zone of the combustion chamber which has oxygen starved air to encourage complete combustion and reduction of harmful emissions.

2. The apparatus of claim 1 wherein the first tube has a plurality of holes equidistantly spaced apart from each other, and the first expansion sleeve has a plurality of holes equidistantly spaced apart from each other that are alignable to the plurality of holes of the first tube.

3. The apparatus of claim 2 wherein the second tube has a plurality of holes equidistantly spaced apart from each other, and the second expansion sleeve has a plurality of holes equidistantly spaced apart from each other that are alignable to the plurality of holes of the second tube.

4. The apparatus of claim 1 further comprising fire resistant putty disposed at the distal ends of one or more of the first, second, third and fourth expansion sleeves for providing an airtight seal between the tubes and expansion sleeves.

5. The apparatus of claim 1 wherein the means for flowing air through the hollow conduit is a blower.

6. The apparatus of claim 1 wherein the air apertures of the second end portion of the hollow tubular conduit are directed downwardly toward a primary combustion zone of the combustion chamber.

7. The apparatus of claim 1 wherein the air apertures of the second end portion of the hollow tubular conduit are directed outwardly from an upper frame disposed in the secondary combustion zone and formed by the hollow tubular conduit.

8. The apparatus of claim 1 wherein the first end portion of the hollow tubular conduit is routed from a fresh air source through the primary combustion zone of the combustion chamber and to the secondary combustion zone of the combustion chamber for preheating the fresh air.

9. The apparatus of claim 1 further comprising a baffle plate disposed in an upper region of the secondary combustion zone of the combustion chamber, the baffle plate having a plurality of channels formed on a lower surface of the baffle plate for disturbing rising combustion gas and incompletely burned particulates.

10. The apparatus of claim 1 further comprising a baffle plate disposed in the secondary combustion zone of the combustion chamber and routes rising combustion gas to the fresh air introduced into the secondary combustion zone of the combustion chamber via the second end portion of the hollow tubular conduit.

11. The apparatus of claim 9 wherein the channels are routed toward an outer periphery of the baffle plate.

12. The apparatus of claim 9 wherein the baffle plate has a plurality of holes extending from a lower surface of the baffle plate to an upper surface of the baffle plate.

13. The apparatus of claim 1 further comprising a log lighter in the secondary combustion zone of the combustion chamber for promoting burning of incompletely burned particulates.

14. The apparatus of claim 13 wherein the log lighter comprises:

an elongate tube connected to a flammable gas source, the elongate tube having a plurality of holes for directing flames in a direction of the plurality of holes, the direction of the plurality of holes being directed toward walls of the combustion chamber.

15. The apparatus of claim 10 further comprising a log lighter in the secondary combustion zone of the combustion chamber wherein the log lighter is positioned in the secondary combustion zone of the combustion chamber with the flames of the log lighter directed into the combustion gas rerouted by the baffle plate.

16. The apparatus of claim 13 further comprising:

one or more log lighters in a primary combustion zone of the combustion chamber;

a logic control unit that supplies gas and ignites one or more of the log lighters in the primary and secondary combustion zones and shuts off gas flow as a function of temperature within the combustion chamber.

17. The apparatus of claim 1 further comprising two or more log lighters in a primary combustion zone below the secondary combustion zone, each log lighter attached to a mixing device, the mixing device comprising:

two or more mixing chambers, each mixing chamber in fluid communication with the log lighter;

a manifold for receiving flammable gas and flowing flammable gas into the mixing chambers through an orifice;

an air conduit in fluid communication with the mixing chamber to introduce fresh air into the mixing chamber, the air conduit directed away from the fuel being burned so that an ignition source does not inadvertently enter the mixing chamber and prematurely ignite the mixed air/fuel.

18. The apparatus of claim 17 wherein each mixing chamber has one air inlet and a common air chamber is in fluid communication with the air inlets so that a single air conduit can feed air into the air inlets.

* * * * *